United States Patent [19]

Hayakawa

[11] Patent Number: 4,970,357

[45] Date of Patent: Nov. 13, 1990

[54] SWITCH DEVICE

[75] Inventor: Hiroshi Hayakawa, Furukawa, Japan

[73] Assignee: Alps Electric Co., Ltd., Tokyo, Japan

[21] Appl. No.: 400,414

[22] Filed: Aug. 30, 1989

[30] Foreign Application Priority Data

Dec. 28, 1988 [JP] Japan ..... 63-168323[U]

[51] Int. Cl.[5] ..... H01H 25/00

[52] U.S. Cl. ..... 200/337; 200/330

[58] Field of Search ..... 200/337, 330, 332, 523, 200/524, 329, 343, 553, 556, 573

[56] References Cited

U.S. PATENT DOCUMENTS

| | | | |
|---|---|---|---|
| 3,291,953 | 12/1966 | Luik | 200/330 |
| 4,352,967 | 10/1982 | Buchtel | 200/343 |
| 4,677,267 | 6/1987 | Oba | 200/524 |
| 4,791,250 | 12/1988 | Yin | 335/172 |

*Primary Examiner*—Henry J. Recla
*Assistant Examiner*—Glenn T. Barrett
*Attorney, Agent, or Firm*—Guy W. Shoup; Paul J. Winters

[57] ABSTRACT

A switch device is provided in which the pressing force imparted to a handling lever is transmitted through a link member to a push switch provided with a push-lock mechanism. Such a device can be used where there is limited mounting space, such as in a vehicle. The invention includes a push switch, a handling lever, a link member, an elongated hole, and a connecting pin moveable within the elongated hole, and is characterized by a restraining wall for synchronizing the position of the handling lever and the state of the slider by restraining the movement of the connecting pin. According to the invention, the state of the push switch which is provided with a push-lock mechanism and the position of the lever are synchronized in that the handling lever does not return to an unpushed position when the slider is in the locked position. This is achieved by the configuration of the connecting pin, the elongated hole and the restraining wall.

4 Claims, 4 Drawing Sheets

SWITCH DEVICE

BACKGROUND OF THE INVENTION

The present invention relates generally to switch device structured such that pressing force to handling knob is transmitted to push switch through link member, and more particularly, to a switch device utilizing push switch provided with push lock mechanism.

For example, as the switch device for fixing to vehicle, in an article that meates various limitation for the mounting place of handling knob or the receiving space of push switch and the like, there is a matter that push switch can not be executed by direct pushing operation with handling knob, in that case, switch device made to transmit the pressing force to handling knob to push switch through link member is employed.

FIG. 4 is a schematic structural diagram illustrating conventional example of switch device of this kind and in the drawing, numeral 1 represents handling knob, said handling knob is rotatably supported to casing 2 such as pannel and the like by pivot 1*a* means, and being urged counterclockwise by torsion coil spring 3. Numeral 4 is push switch, said push switch 4 has driving bar 4*a* protruding to upward, and being structured such that when the driving bar 4*a* reciprocates to up and downward, movable contact point contained within interior is contacted or released to fixed contact point (both are not shown) so that switching of ON: OFF is excuted. Slider 5 is coupled to said driving bar 4*a*, and said slider 5 is defined to move only up and down direction in the drawing by said casing 2, and elongated hole 5*a* is provided at its upper side portion. And, numeral 6 represents link member, one end of said link member 6 is pivotally supported to said handling knob 1 by supporting shaft 6*a*, and other end is coupled to said elongated hole 5*a* by connecting pin.

In the switch device constructed as above, in case that the handling knob 1 is not pressed, the driving bar 4*a* is located at the raised position shown in FIG. 4 by the resilient force of returning spring (not shown) contained therein, and the push switch 4 is at OFF state. In this case, if there is some little dimensional variation at the handling knob 1 and the link member 6 as well as the slider 5, these variation is absorbed by the relative movement of the elongated hole 5*a* and the connecting pin 6*b*, and the position of handling knob 1 is determined with predetermined angle relative to the casing 2. When the handling knob 1 is presed in the direction fo arrow by finger and the like and being turned counterclockwise around the supporting shaft from a state of FIG. 4, since firstly the connecting pin 6*b* of the link member 6 drops within the interior of the elongated hole 5*a* and next the slider 5 drops at a timepoint that the connecting pin 6*b* is abutted to the bottom of the elongated hole 5*a*, the driving bar 4*a* is pressed down and the push switch 4 is switched from OFF to ON. And, when the pressing force to said handling knob 1 is taken off, the driving bar 4*a* and the slider 5 are raised by the returning spring contained within the bush switch 4, the handling knob 1 and the link member 6 are returned to the position of FIG. 4 by the torsion coil spring 3, and the push switch 4 becomes OFF state again.

Inasmuch as the switch constructed as aforementioned is the one that when the handling knob 1 is pressed, the slider 5 is dropped, and when its pressing force is removed, the slider 5 is raised; in case of using the one that is automatically returned without being locked at ON position of the driving bar 4*a*, the movement of the handling knob 1 and the slider 5 can be synchronized. However, in case of the push switch of type that when the push switch provided with push lock mechanism, i.e., the driving bar is pressed, it is locked at ON position, and when pressed again, the lock is released and the driving bar is raised, since the connecting pin 6*b* is possible to be moved up to the top end of the elongated hole 5*a* against the slider 5 located at the lock position, the handling knob 1 is returned by the torsion coil spring 3 despite the slider 5 is locked at the dropped position, and therefore, there is disadvantage that the movement of the handlijg knob 1 and the slider 5 can not be synchronized.

OBJECT AND SUMMARY OF THE INVENTION

The present invention is invented in considering the problem of prior art as these and the requirement, and it is an object of the present invention to provide a switch device capable of synchronizing surely the push switch attached with push lock mechanism with the handling knob.

In order to attain above-mentioned object, the present invention, in a switch device comprising a push switch in which a slider reciprocates between lock position and non-lock position so that the switching of the contact point is executed, a handling knob which is rotatably supported to the casing and being resiliently urged always to the one direction by the returning spring, and a link member for connecting between this handling knob and said slider; is characterized in that an elongated hole is provided to any one of said slider and said link member, at the same time, a connecting pin capable of moving within the interior of this elongated hole is provided to other one, and defining member for obstructing the movement of this connecting pin within the interior of the elongated pin at the lock position of said slider.

In case that the slider of the push switch is located at the non-lock position, the dimensional variation between the slider and the handling knob is absorbed by that the connecting pin being moved within the interior of the elongated hole. And, when the handling knob is pressed and the slider is dropped, since the movement of the connecting pin within the interior of the elongated hole is obstructed by the defining member during the slider is dropped, the handling knob is held at pressing position by the push lock mechanism attached to the push switch at the lock position of the slider.

BRIEF DESCRIPTION OF THE DRAWINGS

For a better understanding of the invention, and to show how the same may be carried out into effect, reference will now be mode, by way of example, with respect to the accompanying drawings, in which.

Throughout the drawings, like reference numerals and symbols are used for designating like or equivalent parts or portions, for simplicity of illustration and explanation.

DETAILED DESCRIPTION OF THE PREFERRED EMBODIMENT

Hereinafter, a preferred embodiment of the present invention will be described in detail with reference to the accompanying drawings.

Figure 1:
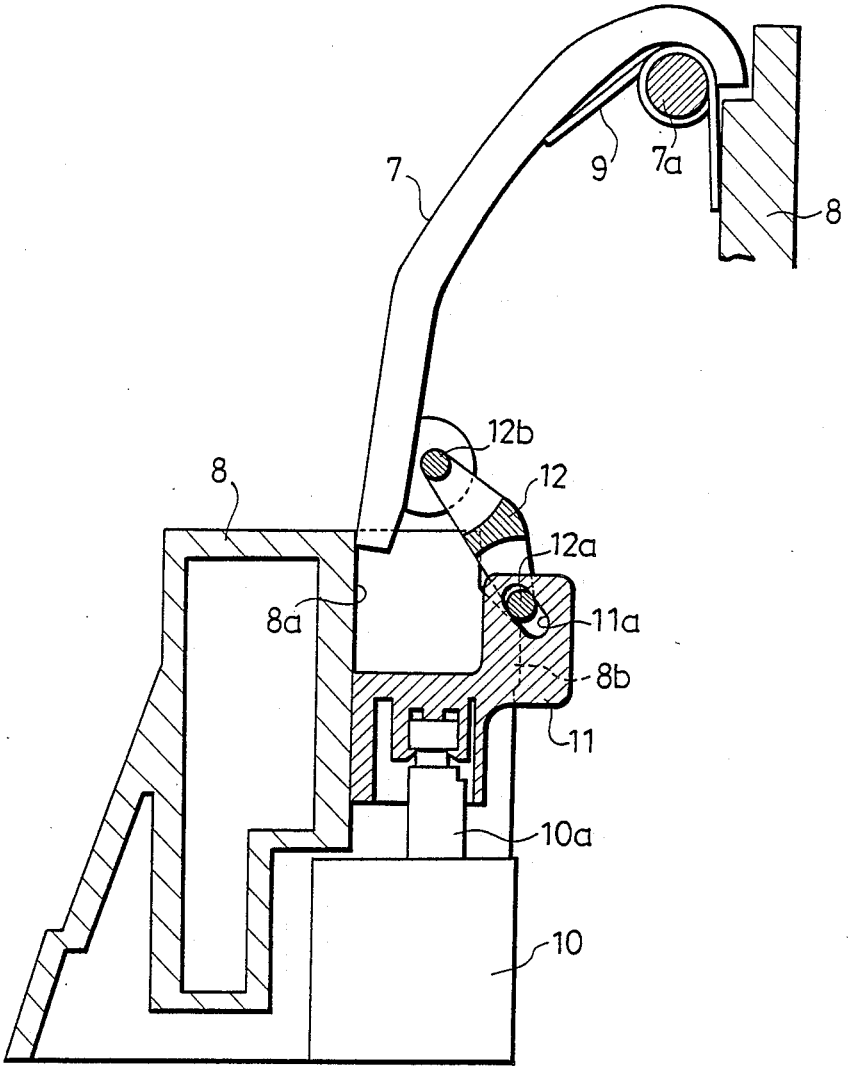
FIG. 1 is a fragmentary cross sectional view of switch device according to a preferred embodiment of the present invention.
Figure 2:
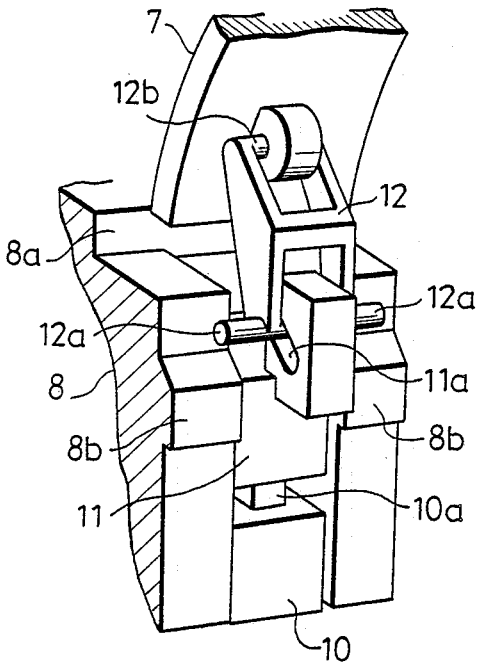
FIG. 2 is a perspective view of essential portion of said switch device, FIGS. 3(*a*), 3(*b*) and 3(*c*) are schematic diagrams for illustrating the operation of said switch device.

FIG. 1 is a fragmentary cross sectional view of switch device according to a preferred embodiment of the present invention, FIG. 2 is a perspective view of essential portion of same, and FIG. 3 is a schematic diagram for illustrating the operation of same.

In FIGS. 1 and 2, numeral 7 represents handling knob, and said handling knob 7 of which supporting shaft 7*a* of top end is rotatably supported to a casing 8 such as pannel and the like. Said handling knob 7 is urged clockwise of FIG. 1 by a torsion coil spring 9 wound to a supporting shaft 7*a*, and its position is determined by a receiving surface 8*a* of the casing 8.

Numeral 10 represent a bush switch provided with a driving bar 10*a*, said push switch 10 is well known one attached with push lock mechanism (not shown) comprised of heart shaped cam and the like, and when a driving bar 10*a* located at raised position is pressed down, the driving bar 10*a* is locked at dropped position and being switched from OFF to ON, when the lock is released by pressing again, the driving bar 10*a* is raised and being switched from ON to OFF.

Numeral 11 represents a slider, said slider 11 is defined so as to able to move only the direction of up and down by said casing 8, and a elongated hole 11*a* extending to diagonal direction is provided at its upper side portion. A link pin 12*a* provided at an end of a link member 12 is movably inserted to this elongated hole 11*a*, and a supporting shaft 12*b* provided at other end of the link member 12 is rotatably supported at the free end side of said handling knob 7. Further, a pair of defining walls 8*b* are provided at said casing 8 so as to cross over the slider 11, the both ends of said connecting pin 12*a* is located within the space of upper side of the defining wall 8*b* in case when the slider 11 is in raised position, but being located at the portion abutting with the defining wall 8*b* in case when the slider is at dropped position (hereinafter be described with respect to this matter).

Next, the operation of said switch device will be described in detail.

FIG. 1 shows OFF state of the push switch 10, in this case, the driving bar 10*a* and the slider 11 are located at both raised position, and the handling knob 7 is located at the position for abutting with the receiving surface by the resilient force of the torsion coil spring 9, and the variation of the relative position between these handling knob 7 and the slider 11 is absorbed by that the connecting pin 12*a* moving within the interior of the elongated hole 11*a*.

Figure 3A:
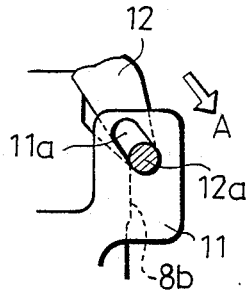
Figure 3B:
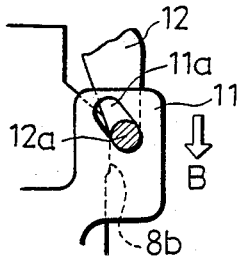

When the handling knob 7 is pressed by a finger and the like from tha state of FIG. 1 and this is turned countercrockwise around the supporting shaft 7*a*, as shown in FIG. 3A, the connecting pin 12*a* of the link member 12 is moved to the diagonal in the direction of arrow A and being abutted to the bottom surface of the elongated hole 11*a*. When the handling knob is further pressed, this pressing force is transmitted to the slider 11 through the link member 12, and the slider 11 is dropped to the direction of arrow B as shown in FIG. 3B. During this slider 11 is dropped, since both ends of the connecting pin 12*a* is dropped along with the vertical surface of the defining wall 8*b*, the free moving (idle moving) of the connecting pin 12*a* within the interior of the elongated hole 11*a* is obstructed at this time point. And, the push switch 10 is switched from OFF to ON state at the time point that the driving bar 10*a* with the slider 11 is dropped as much as predetermined quantity, and this ON state is held by the push lock mechanism. In this case, since the returning of the connecting pin 12*a* within the interior of the elongated hole 11*a* is obstructed by the defining wall 8*b* as aforementioned, as shown in FIG. 3*c*, the handling knob 7 is held at the pressed position by the push lock mechanism.

Figure 3C:
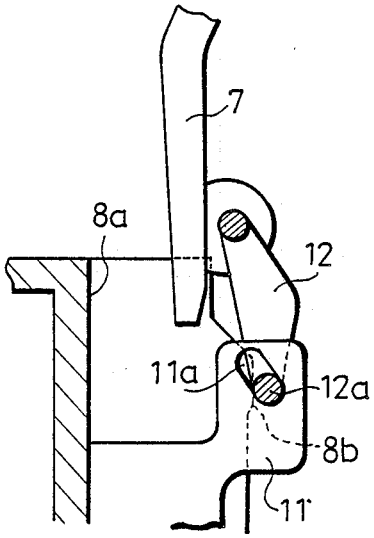
Figure 4:
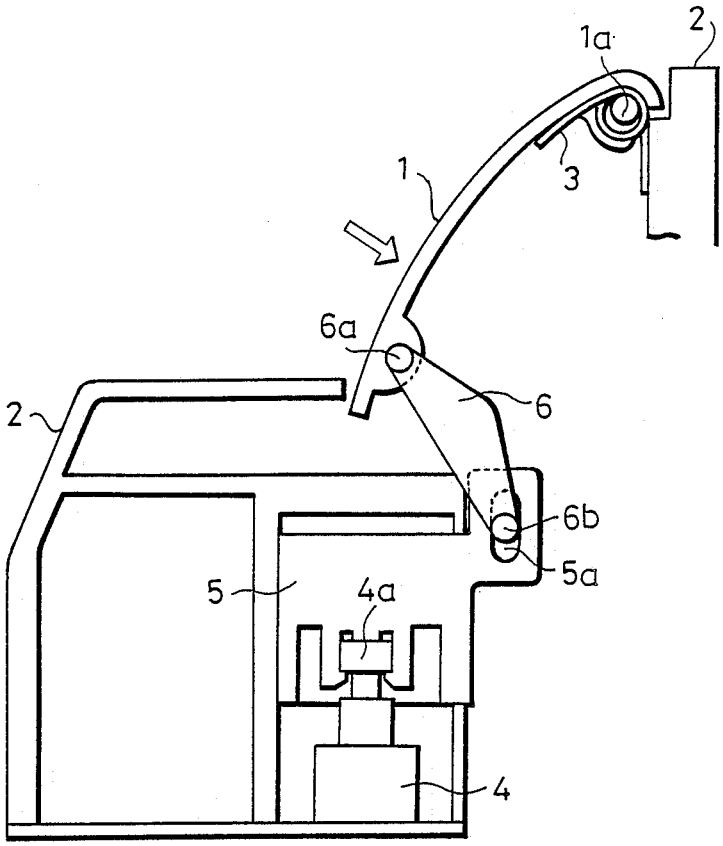
Fig. 4 PRIOR ART
FIG. 4 is schematic structural diagram of conventional switch device.

When the handling knob 7 is pressed a little amount from the state of FIG. 3*c* and the driving bar 10*a* located at the lock position is pressed down through the link member 12 and the slider 11, since the lock by the push lock mechanism is released, the driving bar 10*a* and the slider 11 is raised by the returning spring contained within the push switch 10, the handling knob 7 is returned to the position of FIG. 1 by said returning spring and the torsion coil spring 9, and the push switch 10 becomes OFF state again.

As described above, according to the present invention, since it is the one that idle moving provided between the slider and the connecting pin is made to lose at the position that said slider is locked, the push switch attached with the push lock mechanism and the handling knob can be surely synchronized, and its practical value is very high.

It will be appreciated that the present invention is not restricted to the particular embodiment that has been described hereibefore, and that variations and modifications may be made therein without departing from the sprit and scope of the invention as defined in the appended claims and equivalents thereof.

What is claimed is:

1. A switch device comprising:

a casing;

a handling lever rotatably mounted to said casing and adapted to be pushed in one direction;

a returning spring biasing said handling lever in the direction opposite to which it is pushed;

a push switch mounted in said casing;

means for transmitting a pushing force on said handling lever to the push switch comprising:

a link member connect to said handling lever;

a slider connected to said link member and to said push switch wherein said slider can reciprocate between a locked and a non-locked position in response to a pushing force applied to said handling lever;

connecting means for connecting said slider to said link member comprising:

and elongated hole having a top and a bottom defined by one of said slider and said link member;

a connecting pin slidably located within said elongated hole provided on the other of said slider and said link member;

a restraining wall positioned to restrain said connecting pin from moving from the bottom to the top of said elongated hole when said slider is in said locked position.

2. A switch device comprising:

a casing;

a handling lever rotatably mounted to said casing with respect to said elongated hole;

a returning spring biasing said handling lever in the direction opposite to which it is pushed;

a push switch mounted in said casing;

means for transmitting a pushing force on said handling lever to the push switch comprising:

a link member connected to said handling lever;

a slider connected to said link member and to said push switch wherein said slider can reciprocate between a locked an a non-locked position in response to a pushing force applied to said handling lever;

connecting means for connecting said slider to said link member comprising:

an elongated hole having a top and a bottom defined by one of said slider and said link member and positioned diagonally with respect to movement of said slider;

a connecting pin slidably located within said elongated hole provided on the other of said slider and said link member;

a restraining wall positioned with respect to said elongated hole to restrain said connecting pin from moving from the bottom to the top of said elongated hole when said slider is in said locked position.

3. A switch device comprising:

a casing;

a handling lever rotatably mounted to said casing and adapted to be pushed in one direction;

a returning spring biasing said handling lever in the direction opposite to which it is pushed;

a push switch mounted in said casing;

means for transmitting a pushing force on said handling lever to the push switch comprising:

a link member connected to said handling lever;

a slider connected to said link member and to said push switch wherein said slider can reciprocate between a locked and a non-locked position in response to a pushing force applied to said handling lever;

connecting means for connecting said slider to said link member comprising:

an elongated hole having a top and a bottom defined by one of said slider and said link member;

a connecting pin slidably located within said elongated hole provided on the other of said slider and said link member;

means for restraining said connecting pin from moving from the bottom to the top of said elongated hole when said slider is in said locked position, said means being positioned with respect to said elongated hole.

4. A switch device as in claim 3 wherein said means for restraining the connecting pin from moving to the top of elongated hole when said slider is in said locked position comprises:

a restraining wall.

* * * * *

PRINTER'S TRIM LINE

UNITED STATES PATENT AND TRADEMARK OFFICE

CERTIFICATE OF CORRECTION

PATENT NO. : 4,970,357

DATED : November 13, 1990

INVENTOR(S) : Hiroshi Hayakawa

It is certified that error appears in the above-identified patent and that said Letters Patent is hereby corrected as shown below:

Col. 4 line 56, "and" should read --an--

Col. 4 line 61, after "positioned" insert
--with respect to said elongated hole--

Col. 5 line 9, "an" should read --and--

Signed and Sealed this

Twenty-sixth Day of May, 1992

*Attest:*

DOUGLAS B. COMER

*Attesting Officer*

*Acting Commissioner of Patents and Trademarks*